US007736444B1

(12) United States Patent
Shumilov et al.

(10) Patent No.: US 7,736,444 B1
(45) Date of Patent: Jun. 15, 2010

(54) METHOD AND SYSTEM FOR MANUFACTURING ELECTRICAL SILICON STEEL

(75) Inventors: Vladimir Pavlovich Shumilov, Moscow (RU); Alexandr G. Shalimov, Moscow (RU); Leonard Mironov, Moscow (RU); Urij Christiakov, Moscow (RU)

(73) Assignee: Silicon Steel Technology, Inc., Bernardsville, NJ (US)

( * ) Notice: Subject to any disclaimer, the term of this patent is extended or adjusted under 35 U.S.C. 154(b) by 529 days.

(21) Appl. No.: 11/735,834

(22) Filed: Apr. 16, 2007

Related U.S. Application Data

(60) Provisional application No. 60/745,139, filed on Apr. 19, 2006.

(51) Int. Cl.
*H01F 1/18* (2006.01)

(52) U.S. Cl. ..... 148/122; 148/111; 148/113; 148/121; 148/307; 148/308

(58) Field of Classification Search ..... None
See application file for complete search history.

(56) References Cited

U.S. PATENT DOCUMENTS

| | | | | |
|---|---|---|---|---|
| 745,829 | A | 12/1903 | Hadfield | |
| 836,754 | A | 11/1906 | Hadfield | |
| 836,755 | A | 11/1906 | Hadfield | |
| 836,756 | A | 11/1906 | Hadfield | |
| 836,762 | A | 11/1906 | Hadfield | |
| 2,535,420 | A | 12/1950 | Jackson | |
| 2,599,340 | A | 6/1952 | Littmann et al. | |
| 2,867,558 | A | 1/1959 | May | |
| 3,873,380 | A | 3/1975 | Malagari, Jr. | |
| 3,986,902 | A | 10/1976 | Regitz | |
| 4,202,711 | A | 5/1980 | Littmann et al. | |
| 4,898,626 | A * | 2/1990 | Shoen et al. | 148/111 |
| 5,329,688 | A | 7/1994 | Arvedi et al. | |
| 5,330,586 | A | 7/1994 | Komatsubara et al. | |
| 5,653,821 | A | 8/1997 | Choi et al. | |
| 5,867,558 | A | 2/1999 | Swanson | |
| 6,045,627 | A | 4/2000 | Fujita et al. | |
| 6,296,719 | B1 | 10/2001 | Fortunati et al. | |
| 6,562,473 | B1 * | 5/2003 | Okabe et al. | 428/469 |
| 6,676,771 | B2 * | 1/2004 | Takashima et al. | 148/120 |
| 6,893,510 | B2 * | 5/2005 | Fortunati et al. | 148/111 |
| 6,964,711 | B2 * | 11/2005 | Fortunati et al. | 148/111 |
| 7,192,492 | B2 * | 3/2007 | Fortunati et al. | 148/111 |
| 2002/0011278 | A1 * | 1/2002 | Komatsubara et al. | 148/120 |

FOREIGN PATENT DOCUMENTS

| | | |
|---|---|---|
| CN | 1743127 | 3/2006 |
| EP | 0585956 | 9/1994 |
| JP | 6031397 | 2/1994 |
| WO | WO9953106 | 10/1999 |

OTHER PUBLICATIONS

Key to Metals Task Force & INI Int'l, Silicon Steels and Their Applications, Knowledge Article from www.Key-to-Steel.com, 1999-2006, pp. 1-5 .

Progress in Manufacturing of GO- TK; pp. 4-5, 7-10, May 2005.

* cited by examiner

*Primary Examiner*—John P Sheehan
(74) *Attorney, Agent, or Firm*—Marger, Johnson & McCollom, P.C.

(57) ABSTRACT

Grain oriented electrical steel is made in a manner that the grains are selectively grown to obtain a crystal structure known as cube-on-edge and the grains are largely aligned in the rolling direction. Selection of chemistry and process route along with thin slab continuous casting enables the production of Grain oriented electrical steel such that less energy is consumed in the process, certain process steps can be combined, yield is better and the product can be manufactured within a wider process control tolerance.

34 Claims, No Drawings

METHOD AND SYSTEM FOR MANUFACTURING ELECTRICAL SILICON STEEL

RELATED APPLICATION

This application is a non-provisional application of provisional application Ser. No. 60/745,139 filed Apr. 19, 2006. Priority of application 60/745,139 is hereby claimed. The entire contents of application 60/745,139 are hereby incorporated by reference

BACKGROUND OF THE INVENTION

This invention is a method for the production of grain oriented electrical steel, and more particularly, grain oriented silicon electrical steel, starting from a thin slab. In one embodiment, this method refers to a product formation route which enables efficient production with better yield and wider process control tolerance.

The prior art describes variations of the product and the process to make many variations of electrical steels. Patents issued to Hadfield starting in 1903 (such as U.S. Pat. Nos. 745,829; 836,762; 836,754; 836,755; 836,756) are among the earliest patents in the field of this invention. Such patents describe the magnetic performance of electrical steels and the composition for making electrical steels with methods using the technology available around the year 1900. Patents assigned to Armco Steel Corporation, Ohio and the General Electric Company, New York, from the year 1950 onward (such as U.S. Pat. Nos. 2,535,420; 2,599,340; 2,867,558) describe variations and improvements to the product and process to incorporate continuous manufacturing operations and improved process control.

Traditionally, electrical steels have been made by casting ingots or slabs that are 200-250 mm thick. In such processes large oriented grain growth is obtained in the final stages of the process at a step referred to High Temperature Anneal (HTA) where the steel strip is held at elevated temperatures of around 1200° C. for an extended period of time. In the HTA step certain chemical systems inhibit the growth of general or normal grains while allowing the large oriented grains to grow. These chemical systems are referred to as the "inhibitor system" for a given process. In the past, electrical steels have used one of two inhibitor systems, which are the (a) sulfide-manganese system, and (b) nitride-aluminum system.

The sulfide-manganese system has been known to result in high quality electrical steels but it has several major drawbacks. It requires high temperature reheat of the slab to redissolve the inhibitor species which tend to escape from the iron crystal grains when the slab is solidifying after casting. It also requires tight process control since sulfur has a high propensity to escape from the iron crystal grains. Moreover, when sulfur rich chemical species collect at the grain boundaries they cause the problem of red-shortness or hot-shortness which results in cracking and breakage of steel strips and results in yield loss.

The nitride-aluminum system has been used to make electrical steels with a lower reheat temperature of the slab. But since a thick slab (200-250 mm) takes a considerable time to solidify it still provides an environment in which the inhibitor species escape from the iron crystal grains. As such the process has a few drawbacks: 1) it still requires an energy intensive reheat step; and 2) the inhibitor species have a propensity to chemically combine with other impurities present in the steel and thus result in lower levels of inhibitors at the HTA step and also create new impurities that compromise the performance and properties of the finished electrical steel.

In the recent past attempts have been made to produce electrical steels using sulfide-manganese inhibitor systems along with thin slab casting technology which casts a slab from 20-80 mm (see for example U.S. Pat. No. 6,296,719). This offers the benefit of low energy consumption since the slab can be rolled to final gauge from a much smaller starting thickness. It also offers the benefit of obtaining favorable microstructure in the slab. But since it is based on sulfide-manganese inhibitor systems, the process still requires slab reheat to about 1300° C. and still is susceptible to the drawbacks which are characteristic of such systems.

SUMMARY OF THE INVENTION

The subject method for producing silicon electrical steel utilizes cheaper inputs, less energy, combines and overlaps production process steps, improves yields and product uniformity. In one embodiment this is accomplished by making the method more tolerant to a wider range of process parameters.

Soft iron provides flux magnification in an electromagnetic system. Approximately four orders of magnitude less current is needed to produce a magnetic field of given strength in a solenoid with a soft iron core versus a solenoid with no core. The ideal core would be one that magnetizes and demagnetizes instantaneously, looses no energy in the process, maintains this behavior forever and is small in size. Electromagnetic systems approach this ideal through a combination of core design and how it is powered on one hand and properties of the core material on the other hand. Electrical steel is manufactured to provide the best options for making core material.

It has now been determined that electrical steels can be produced which approach the properties of an ideal core through the use at least some of the following approaches. For example, laminating can be employed in making the core from thin insulated sheets which reduces power lost to eddy currents. Alloying increases the resistivity of iron and further reduces eddy currents. Silicon is the preferred alloying element for this purpose. Specific elements like Cu, Mn, S, Al, N, etc., can be added to inhibit normal grain growth and allow only large oriented growth in advanced stages on processing. Purifying by reduction of carbon greatly improves rapid magnetization and allows the core to maintain favorable qualities for a longer time. Annealing removes stressed regions and dislocations of the crystal lattice and thus improves rapid magnetization. Since boundaries between grains are impediments to rapid magnetization, electrical steels can be processed to result in large grains. Electrical steels are processed to result in cube-on-edge grains which are oriented in the direction of rolling. Grain control, the process to grow oriented grains, tends to create grains that can be so large that losses due to eddy currents start overshadowing the benefits of size. Lasers may be used to induce artificial grain boundaries and control the size to an optimum level and thus reduce loss of power.

In an embodiment herein, the inhibition of conventional crystalline growth is obtained primarily through the use of complex compounds of N, Cu, Al, Si. In another embodiment, and to a lesser extent, this inhibition is accomplished by employing compounds of N, Cu, Al, and Si with Mn and S. In still another embodiment, the inhibitor system is a nitride system specifically a nitride-cupric system which is characterized by a high level of Cu as compared to known nitride-aluminum inhibitor systems and a markedly low S to Mn ratio as compared to known sulfide-manganese inhibitor systems. While nitride-aluminum species play an important role in the inhibition process, the present invention differs from traditional nitride-aluminum inhibition systems in that the processing in the HTA step is adjusted to enable formation of an excess of a copper based inhibition species ($Cu_5Si$, $CuMn_2O_4$).

By using a nitride-cupric system, this invention realizes the benefits of (a) use of cheaper Cu containing scrap iron as a feedstock option, (b) better yields through vastly reduced strip breakage, (c) less energy consumption by reducing the dependence on slab reheat which traditionally re-dissolves sulfur and related inhibiting species into the iron crystal lattice and (d) wider range of tolerance on process control since the inhibitor species are more stable than sulfur and additional inhibitors are formed in the later stages of the process.

In a further embodiment an extremely thin slab is cast, and the casting process is designed and controlled so as to achieve rapid solidification, which in turn significantly minimizes the segregation zone and columnar grain structure in the slab. This can also ensure that inhibiting species do not get enough time to migrate to the grain boundaries and thus the need for high temperature slab reheat is further reduced. This method utilizes a thin slab casting process along with the nitride-cupric system and specific process parameters in the processing steps to overcome the problems described above with respect to conventional electrical steel manufacturing processes.

DETAILED DESCRIPTION

A process for producing grain oriented electrical steel is provided. The process comprising forming molten liquid steel. In certain embodiments this is accomplished by melting scrap iron (or steel) or by direct reduced iron (DRI) or hot briquetted iron (HBI) or iron from any combination of the above sources or any other conventional sources. In a further embodiment the melting process is conducted in an Electric Arc Furnace (EAF).

The melted steel in liquid form then has its chemical composition adjusted. First, a substantial portion of the carbon (C) in the molten liquid steel is removed. In one embodiment, the amount of C remaining in the molten steel is not more than about 1%, in a further embodiment not more than about 0.5%, and in still a further embodiment not more than about 0.05% by weight, based on the weight of the molten steel. In still another embodiment, the amount of C can be from about 0.02 to 0.035% for grain oriented steels, and from about 0.003 to 0.009% for other electrical steels. In an embodiment herein, C is removed by refining the melt using a Vacuum Oxygen Degasser (VOD) or Vacuum Tank Degassing (VTD) or Argon Oxygen Decarburization (AOD) or Vacuum Recirculation (RH) or other methods to obtain the requisite carbon removal.

Next, the chemical composition is further adjusted at a metallurgical station so that the amount of certain elements remain in the molten steel. The respective order of removing carbon on the one hand, and the adjustment of the chemical composition on the other hand, may in one embodiment be reversed.

In practice, the chemical composition is adjusted at a metallurgical station where the molten steel is held in a vat called a ladle. The feedstock is chosen such that apart from C, all other alloying chemicals (all other elements other than Fe) will be lower than the desired target levels. So any adjustment to the chemical composition will be additive. The chemical composition of a sample of the molten steel from the ladle is determined. The difference in percentage content of the critical chemicals (between actual measurement from the sample and the target values) is determined. Additional alloying elements are added into the ladle to make up the difference.

The inhibiting compounds are primarily complex compounds of Cu, Al, N, and Si and secondarily, compounds of Cu, Al, N, and Si with Mn and S. The inhibiting compounds are collectively referred to as an inhibition system, which in this invention is called a nitride-cupric system. It is different from the nitride-aluminum inhibition system in that it contains copper and it is different from the sulfide-manganese inhibition system in that S to Mn weight ratio is many times lower in the nitride-cupric inhibition system. In a typical embodiment, the S:Mn ratio is between about 0.02 and 0.04.

In one embodiment, the amount of Cu remaining in the molten steel is not more than about 1%, in a further embodiment not more than about 0.55%, and in still a further embodiment not more than about 0.45% by weight, based on the weight of the molten steel. In another embodiment, the amount of Al remaining in the molten steel is not more than about 0.5%, in a further embodiment not more than about 0.2%, and in still a further embodiment not more than about 0.1% by weight, based on the weight of the molten steel. In one embodiment, the amount of Si remaining in the molten steel is not more than about 5%, in a further embodiment not more than about 3.5%, and in still a further embodiment not more than about 2.5% by weight, based on the weight of the molten steel. In still another embodiment, the amount of N remaining in the molten steel is not more than about 0.05%, in a further embodiment not more than about 0.011%, and in still a further embodiment not more than about 0.0008% by weight, based on the weight of the molten steel. In a further embodiment, the amount of Mn remaining in the molten steel is not more than about 0.3%, in another embodiment not more than about 0.22%, and in still a further embodiment not more than about 0.15% by weight, based on the weight of the molten steel. In another embodiment, the amount of S remaining in the molten steel is not more than about 0.05%, in a further embodiment not more than about 0.01%, and in still a further embodiment not more than about 0.004% by weight, based on the weight of the molten steel. In another embodiment, the Cu to N weight ratio is at least about 40, in a further embodiment at least about 45, and in an alternative embodiment at least about 50. The chemical composition can be such that it forms compounds that inhibit the growth of ordinary grains of iron and allows only such grains to grow which contain a majority of iron crystals that are arranged in cubes lying down on their edges (cube-on-edge crystals) and aligned in the direction of the length of the final strip of steel.

The compositional adjustment described above can be affected with the use of Electric Arc Heating. This will facilitate matching the predetermined starting composition ranges set forth above.

A thin slab of molten steel is cast, typically continuously, while using the nitride-cupric inhibition system and specific process parameters to realize the benefits of thin slab technology while overcoming the drawbacks of thick slab casting and processing methods. In one embodiment the thin slab has a finished thickness of between about 10 and 80 mm, in another embodiment between about 30 and 75 mm, and in a further embodiment between about 45 and 70 mm. In still another embodiment the slab formation is conducted in an inert gaseous atmosphere to minimize interference with the molten steel by the surrounding environment. In a different embodiment, the thin slab reaches a point of substantially complete solidification within a period of time of not greater than about 60 seconds, in a still different embodiment not greater than about 90 seconds, and an even different embodiment not greater than about 120 seconds and has an internal grain structure that is primarily homogenous.

In an embodiment of this invention, a thin slab is cast using a continuous caster, wherein the molten steel with the desired chemical composition is poured though a mold. The steel solidifies in the shape of a thin slab with a rectangular cross-section as it emerges from the mold. At the exit from the mold the shell of the slab (faces, edges and corners) is solidified while the core is still in liquid state. The thin slab emerges in a vertically downward from the mold and as it continues to emerge from the mold it is guided by a set of rollers that guide it from the vertical plane to the horizontal plane while the core also solidifies. The rollers are made to apply pressure on the strand, before and during solidification of the core of the thin slab, to reduce its thickness. This provides a way to reduce the slab thickness and homogenize the internal structure of the slab.

In one embodiment the thickness of the cast slab during casting is reduced by applying pressure, as described above, while the center core of the slab has solidified but is not completely hardened. This method is known as Soft Core Reduction (SCR). In another embodiment the thickness of the cast slab during casting is reduced by applying pressure, as described above, while the center core of the slab is still in liquid state. This method is known as Liquid Core Reduction (LCR). In another embodiment the cast slab during casting is rapidly cooled using water or other means to ensure solidification in a relatively short time period as described above. In still a further embodiment, stirring the liquid core of the cast slab during casting is provided by using electromagnetic force, while the center core of the slab is still in liquid form.

In an embodiment of this invention, the casting speed is controlled to between about 3 and 6 meters/min., in another embodiment between about 2 and 10 meters/min. In an additional embodiment, the thin slab is bent within a radius of from about 2 to 6 meters. The casting speed is controlled while applying Liquid Core Reduction (LCR) or Soft Core Reduction (SCR) or both, and in a further embodiment by applying intensive cooling or magnetic stirring or both, and bending the formed slab as described above to obtain solidification in the prescribed time and a microstructure conducive to further processing.

During the process of casting the slab unavoidable scale is formed on the surface due to atmospheric reaction. The slab can then be descaled with high pressure water.

The thin slab is heated to achieve a uniform temperature level in all parts and surfaces up to a temperature to facilitate hot rolling. Heating of the slab can be conducted in a tunnel furnace. In an embodiment of this invention, the heating step is conducted to a temperature of not more that about 1230° C.

The thin slab is then reduced in thickness and the inhibition system present within the thin slab, as described above, and in an embodiment forms inhibitors which facilitate effective and efficient oriented grain formation. In a further embodiment, first hot rolling of the thin slab is employed to reduce the thickness to form a thin strip of steel. In one embodiment, hot rolling is conducted on a reversing (Steckel) mill. In an embodiment of this invention, the slab thickness is reduced to about 1 mm to 3 mm. In yet another multi-step; embodiment, the slab initial thickness is reduced during casting, before and during solidification, and is then directly rolled after casting to the resultant thickness described above. The initial thickness can be between about 10 to 20 mm. The multi-step thickness reduction can be conducted in a continuous manner.

In a further embodiment, first hot rolling is conducted at a finishing temperature. The finishing temperature can be between about 950° C. to 1050° C., in still further embodiment from about 900° C. to 1100° C.

In an embodiment of this invention, the strip is cooled for further handling and processing. In an embodiment herein, a water spray is used to rapidly cool the thin strip to about ambient temperature. In another embodiment, the thin strip is cooled without a water spray after the hot rolling In one embodiment the cooling time without a water spray is up to about 15 seconds. This step can be conducted prior to using water spray to rapidly cool the thin strip to about 700° C., in still further embodiment to about 500° C.

In an embodiment, the formation of up to about 25%, in another embodiment up to about 20%, and in a further embodiment up to about 15%, of cube-on-edge grains is provided in the thin strip.

Unavoidable scale can be formed on the surface due to atmospheric reaction. If scaling occurs, the scale is removed by passing the thin strip through an acidic or oxidizing environment. In one embodiment, the scale may be removed by passing the thin strip though a plasma.

The thin strip, in one embodiment, is maintained between a temperature of about 1050° C. to 1150° C. in a furnace. In another embodiment, the temperature is maintained for a period of time of about 2 to 3 minutes, in still another embodiment from about 3 to 5 minutes. In one embodiment, this is a technique for producing more of the grain formation inhibitors.

If necessary, the strip is treated for scale removal prior to subsequent cold rolling. This is accomplished in a manner similar to the removal process described above.

The thickness of the thin strip can then be further reduced. In one embodiment, this is accomplished by cold rolling the thin strip in a rolling mill. In an embodiment the thickness is reduced to from about 0.3 mm to 0.9 mm, in still another embodiment from about 0.1 mm to 0.3 mm.

Removing carbon can then be provided by decarburizing the thin strip in a furnace with an oxidizing environment. Decarburizing of the thin the strip is conducted in one embodiment at a temperature of at a temperature of between about 800° C. to 900° C., in another embodiment to a temperature of not more that about 1000° C. In one embodiment, the time period for conducting decarburization is from about 5 to 7 minutes, in still another embodiment from about 7 to 9 minutes.

In another embodiment, prior to reaching the above-described decarburizing temperature, the temperature is raised to about 700° C., in less than 1 minute, to reduce the total time for decarburizing the thin strip. A compact induction heating system can be employed for this purpose.

In an embodiment of this invention, decarburization is conducted in a wet nitrogen rich atmosphere in a furnace. An insulative layer can be formed on the exposed surface. This can be accomplished by adjusting the ratio of partial pressure of water to the partial pressure of hydrogen. This ratio in one embodiment can be between about 0.1 to 0.26. This insulative layer can be formed in order to provide a preliminary dispersion of subsurface insulating particles. In an embodiment of this invention, the insulating layer forms a mixture of iron oxide and silicon oxide particles on and below the exposed outer surface of the thin strip.

Next, annealing of the thin strip is conducted for growing iron crystals. Annealing of the thin the strip is conducted in a furnace, in one embodiment at a temperature of at a temperature of between about 800° C. to 900° C., in another embodiment to a temperature of not more that about 1000° C. In one embodiment, the time period for conducting decarburization is for about 5 to 7 minutes, in still another embodiment from about 7 to 10 minutes.

The thin strip thickness can be further reduced. This can be done by a second cold rolling step. In an embodiment the thickness is reduced to from about 0.10 mm to 0.50 mm in a rolling mill, in still another embodiment from about 0.02 mm to 0.1 mm. In an embodiment of this invention, the first and/or second cold rolling can be performed on one of a reversing mill or a continuous mill.

In an embodiment, cold rolling is conducted to a final thickness in a single step on a rolling mill prior to annealing and decarburizing as described above. In another embodiment, the thin strip is annealed and decarburized in a single step after the first cold rolling and before the second cold rolling. In an alternative embodiment, the thin strip can be treated with ammonia after the first cold rolling and before the second cold rolling step, or the thin strip can be treated with ammonia after the second cold rolling.

Coating of the strip can be provided by passing the thin strip through a tank filled with the coating material, which protects the rolled strip from sticking to itself in subsequent high temperature processing steps. In one embodiment, the coating is MgO, in another embodiment a slurry of MgO, and in a further embodiment MgO with Ti and/or Cr based additives. The coating can be dried in a furnace after application, in one embodiment at a temperature of between about 500° C. to 600° C.

In a further embodiment the coated thin strip is heated in a furnace where the temperature is controlled so as to complete the formation of a Cu-based grain growth inhibiting species. In an embodiment of this invention, the rate of heating of the coated thin strip is controlled to about 50° C./hour, in another embodiment to about 35° C./hour, and in a further embodiment to about 25° C./hour. Heating can be conducted at a temperature of between about 700° C. to 1000° C.

In still another embodiment, annealing is processed in a gaseous hydrogen atmosphere in a furnace to grow oriented crystalline grains in the coated thin strip and to form a grain oriented electrical steel strip. In another embodiment, larger grains within the thin strip can be arranged in cubes lying down on their edges and aligned in the direction of the length of the strip. In a further embodiment, annealing is conducted at a temperature of up to about 1300° C., in another embodiment at a temperature of up to about 1200° C., and in a further embodiment at a temperature of up to about 1100° C. In a still further embodiment, annealing extends for from about 25 up to about 35 hours. A gaseous atmosphere of hydrogen or ammonia can be a useful mode for conducting the annealing. High Temperature Annealing (HTA) of the thin strip can be an effective way of carrying out the subject annealing process.

The grain oriented thin strip can be straightened or flattened. This is done, in one embodiment, under tension. In another embodiment, it is accomplished by applying tension at a temperature between about 500° C. to 900° C. In an embodiment, the grain size of the straightened strip can be reduced by applying energy thereto in the form of physical forces or by laser energy after the straightening step The thin strip can be coated by passing the thin strip through a tank filled with the coating material. In one embodiment an insulative coating is applied to the thin strip. In another embodiment, the step of applying an insulative coating can comprise providing an insulative coating of phosphoric acid, MgO and aluminum hydroxide to the grain oriented thin straightened strip.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A process for producing grain oriented electrical steel comprising:

i) forming molten liquid steel;

ii) removing carbon from the molten liquid steel, the amount of carbon remaining in the molten liquid steel being not more than about 0.05% by weight, based on the weight of the molten liquid steel;

iii) adjusting the chemical composition of the molten liquid steel before or after removing carbon therefrom so that the amount remaining in the molten liquid steel is not more than about 0.05% by weight, the amount of Cu is up to about 1%, the amount of Al is up to about 0.5%, the amount of N is up to about 0.05%, the amount of Mn is up to about 0.3% and the amount of Si is up to about 5%, by weight, based on the weight of the molten steel, the Cu to N weight ratio being at least about 40;

iv) continuously casting a thin slab from the molten liquid steel of step iii), said thin slab having a finished thickness of between about 10 and 80 mm in an inert gaseous atmosphere to minimize interference with the molten liquid steel by the surrounding environment;

v) controlling the casting speed to between about 2 and 10 meters/min;

vi) bending the thin slab from a vertical plane to a horizontal plane within a radius of from about 2 to 6 meters;

vii) solidifying the thin slab of step vi) within a period of time not greater than about 120 seconds from initiating continuous casting in step iv);

viii) descaling the solidified thin slab of step vii) with an aqueous liquid;

ix) heating the solidified thin slab of step viii) up to a temperature of not more that about 1250° C. to facilitate hot rolling;

x) hot rolling the solidified thin slab of step ix) to a thickness of about 1 to 3 mm at a finishing temperature of between about 950° C. to 1050° C. to form a thin strip of steel;

xi) rapidly cooling the thin strip with water, the cooled thin strip comprising grains, including up to about 25% cube-on-edge grains, based on the total amount of said grains;

xii) maintaining the thin strip of step xi) at a temperature of from about 1050° C. to 1150° C. and removing scales from the thin strip of step xi);

xiii) first cold rolling of the thin strip of step xii) to a thickness of about 0.1 to 0.9 mm;

xiv) removing carbon by decarburizing the thin strip of step xiii) at a temperature of between about 800° C. to 900° C. for about 5 to 7 minutes in an atmosphere of water vapor;

xv) adjusting a ratio of a partial pressure of water to a partial pressure of hydrogen with respect to the atmosphere of step xiv) to between about 0.1 to 0.26 to form a mixture of iron oxide and silicon oxide particles on and below the exposed outer surface of the thin strip of step xiv);

xvi) annealing the thin strip of step xv) for growing iron crystals at a temperature of about 800° C. to 900° C. for a period of time from about 5 to 7 minutes;

xvii) second cold rolling of the thin strip of step xvi) to a thickness of up to about 0.35 mm;

xviii) coating the thin strip of step xvii) with a slurry of MgO;

xix) drying the coated thin strip of step xviii);

xx) controlling the rate of heating of the coated thin strip of step xix) to about 50° C./hour at a temperature of between about 700° C. to 1000° C. to complete the formation of a Cu-based grain growth inhibiting species;

xxi) annealing the coated strip of step xx) at a temperature of between about 1100° C. and 1300° C. in a gaseous hydrogen atmosphere to grow oriented crystalline grains in the coated thin strip and to form a grain oriented thin strip;

xxii) straightening the grain oriented thin strip of step xxi) under tension; and xxiii) applying an insulative coating comprising phosphoric acid, MgO and aluminum hydroxide to the grain oriented thin straightened strip of step xxii).

2. Process according to claim 1, wherein the amount of carbon remaining in the molten liquid steel in step ii) is not more than about 0.035% by weight.

3. Process according to claim 1, wherein the grain oriented thin strip of step iii) has a composition wherein the amount of Cu is not more than about 0.5%, the amount of Al is up to about 0.02%, the amount of N is up to about 0.02%, the amount of Mn is up to about 0.22%, and the amount of Si is up to about 3.5%, by weight, based on the weight of the molten liquid steel.

4. Process according to claim 1, wherein the molten liquid steel is formed in an open hearth furnace or a blast furnace or an electric arc furnace.

5. Process according to claim 1, wherein the thin slab starting thickness is reduced to the finished slab thickness, before and during solidification of the molten liquid steel, in a guiding system of a casting machine.

6. Process according to claim 1, wherein the thickness of the cast slab is reduced during casting by applying pressure while the center core of the cast slab is still in liquid form.

7. Process according to claim 1, wherein the thickness of the cast slab during casting is reduced by applying pressure while the center core of the slab has solidified but is not completely hardened.

8. Process according to claim 1, which further includes applying cooling to the slab during casting.

9. Process according to claim 1, which further includes stirring the liquid core of the cast slab during casting, using electromagnetic force, while the center core of the slab is still in liquid form.

10. Process according to claim 1, wherein the finished thickness of the thin slab of step iv) is between about 45 and 70 mm.

11. Process according to claim 1, wherein the slab thickness is reduced during casting in step iv) to a thickness of between about 10 to 20 mm.

12. Process according to claim 1, wherein the thin slab is cast, directly at the exit of a mold, to a thickness of between about 1 to 7 mm.

13. Process according to claim 1 wherein the step of heating the solidified thin slab of step viii) up to a temperature of not more than about 1250° C. to facilitate hot rolling in step x), is conducted in a tunnel furnace.

14. Process according to claim 1, wherein the solidified thin slab of step vii) is maintained at a temperature between about 1050° C. to 1150° C. for about 2 to 3 minutes prior to descaling of the solidified thin slab of step vii).

15. Process according to claim 1, wherein hot rolling is on a reversing (Steckel) mill.

16. Process according to claim 1, wherein the thin strip of step x) is cooled in ambient air for up to about 15 seconds after the hot rolling prior to rapidly cooling with water in step xi).

17. Process according to claim 1, wherein the first and/or second cold rolling is performed on a reversing mill.

18. Process according to claim 1, wherein the first and/or second cold rolling is performed on a tandem mill.

19. Process according to claim 1, wherein the second cold rolling step is performed in a single step prior to annealing and decarburizing.

20. Process according to claim 1, wherein the MgO slurry comprises MgO including Ti and/or Cr.

21. Process according to claim 1, wherein drying the coated thin strip is conducted at a temperature of between about 500° C. and 600° C.

22. Process according to claim 1, wherein, prior to reaching the decarburizing temperature of about 800° C. to 900° C., rapidly raising the temperature to about 700° C. using a compact induction heating system, to reduce the total time for decarburizing the thin strip.

23. Process according to claim 1, wherein the thin strip is treated with ammonia after the first cold rolling and before the second cold rolling.

24. Process according to claim 1, wherein the thin strip is treated with ammonia after the second cold rolling.

25. Process according to claim 1, wherein controlling the rate of heating of the thin strip of step xix) is at a rate of at least about 25° C./hour.

26. Process according to claim 1, wherein the annealing of step xxi) is conducted at a temperature of up to about 1200° C.

27. Process according to claim 1, wherein the annealing of step xxi) is conducted in an atmosphere of ammonia.

28. Process according to claim 1, in which the grain size of the straightened strip is reduced by applying energy thereto in the form of physical forces or by laser energy after the straightening step.

29. Process according to claim 1, wherein the casting speed is controlled to between about 3 and 6 meters/min.

30. Process according to claim 1, wherein bending the thin slab from a vertical plane to a horizontal plane is within a radius of from about 2 to 6 meters.

31. Process according to claim 1, wherein obtaining substantial solidification of the thin slab of step iv) is provided within a period of time not greater than about 60 seconds from initiating continuous casting of step iv).

32. Process according to claim 1, wherein descaling the thin slab with an aqueous liquid is conducted at high pressure of between about 20 to 40 MPa.

33. Process according to claim 1, wherein annealing the coated strip is conducted for up to about 30 hours in the gaseous hydrogen atmosphere.

34. Process according to claim 1, wherein straightening the grain oriented thin strip under tension is conducted at a temperature between about 500° C. to 900° C.

* * * * *

UNITED STATES PATENT AND TRADEMARK OFFICE

CERTIFICATE OF CORRECTION

PATENT NO. : 7,736,444 B1
APPLICATION NO. : 11/735834
DATED : June 15, 2010
INVENTOR(S) : Vladimir Pavlovich Shumilov et al.

It is certified that error appears in the above-identified patent and that said Letters Patent is hereby corrected as shown below:

On the Front Cover, item (73), the Assignee "Silicon Steel Technology, Inc." should read -- Silicon Steel Technology, LLC --.

Signed and Sealed this
Tenth Day of May, 2011

David J. Kappos

David J. Kappos
*Director of the United States Patent and Trademark Office*